US006652725B2

(12) United States Patent
Taniguchi et al.

(10) Patent No.: US 6,652,725 B2
(45) Date of Patent: Nov. 25, 2003

(54) ELECTRODEPOSITION APPARATUS FOR PRODUCING ELECTRODEPOSITED COPPER FOIL AND ELECTRODEPOSITED COPPER FOIL PRODUCED BY THE APPARATUS

(75) Inventors: Kazuko Taniguchi, Ageo (JP); Makoto Dobashi, Ageo (JP); Hisao Sakai, Ageo (JP); Yasuji Hara, Ageo (JP)

(73) Assignees: Mitsui Mining, Tokyo (JP); Smelting Co., Ltd., Tokyo (JP)

( * ) Notice: Subject to any disclaimer, the term of this patent is extended or adjusted under 35 U.S.C. 154(b) by 100 days.

(21) Appl. No.: 09/838,322

(22) Filed: Apr. 20, 2001

(65) Prior Publication Data

US 2001/0042686 A1 Nov. 22, 2001

(30) Foreign Application Priority Data

May 18, 2000 (JP) ..... 2000-145924

(51) Int. Cl.[7] ..... C25C 1/12; C25C 3/06; C25D 1/04; C25D 17/00; C25B 15/00

(52) U.S. Cl. ..... 205/50; 205/77; 205/349; 205/585; 205/586; 205/392; 205/393; 204/238; 204/206; 204/276

(58) Field of Search ..... 205/77, 586, 349, 205/585, 50, 392, 393; 204/206, 238, 276

(56) References Cited

U.S. PATENT DOCUMENTS 5,181,770 A * 1/1993 Brock et al. ..... 205/77
5,834,140 A * 11/1998 Wolski et al. ..... 205/77 X
6,444,112 B1 * 9/2002 Imada et al. ..... 205/586

* cited by examiner

*Primary Examiner*—Donald R. Valentine
(74) *Attorney, Agent, or Firm*—Rothwell Figg Ernst & Manbeck

(57) ABSTRACT

An object of the invention is to provide a method for continuously producing electrodeposited copper foil while thiourea-decomposed products remaining in copper electrolyte are removed through activated carbon treatment. Another object is to provide high-resistivity copper foil obtained through the method. The present invention further provides an electrodeposition apparatus including a path for circulating a copper sulfate solution, whereby in said path is provided a filtration means for removal of thiourea-decomposed products remaining in copper electrolyte.

27 Claims, 5 Drawing Sheets

ELECTRODEPOSITION APPARATUS FOR PRODUCING ELECTRODEPOSITED COPPER FOIL AND ELECTRODEPOSITED COPPER FOIL PRODUCED BY THE APPARATUS

TECHNICAL FIELD

The present invention relates to an electrodeposited copper foil and a process for continuously producing the electrodeposited copper foil, and more particularly to a technique which allows use of a thiourea-added copper sulfate solution.

BACKGROUND ART

In the field of electrodeposition and electroforming of copper, it has conventionally been known that electrolysis by-products and impurities remaining in a copper electrolyte greatly affect the physical properties of electrodeposited products obtained through electrolysis. Among the products, electrodeposited copper foil is used for forming circuits to allow the flow of current in printed wiring boards, and therefore, electric resistance of a required level must be provided. Thus, at the production stage of electrodeposited copper foil, it is desirable to remove undesired impurities and contamination by undesired matter to the greatest possible extent. Generally, such undesirable electrolysis by-products and impurities remaining in a copper electrolyte are removed by a variety of methods; e.g., use of filter cloth, activated carbon, ion-exchange resin, or a similar material.

Among additives for a copper electrolyte, thiourea is known to be a compound capable of imparting remarkably high hardness to electrodeposited copper. Accordingly, there have been investigated a variety of methods for mass-producing electrodeposited copper from an electrolyte to which thiourea alone is added.

However, thiourea incorporated into a copper electrolyte forms, through oxidation such as electrode oxidation or oxidation by oxygen gas, FD (formamidine disulfide), derivatives thereof, thiosulfuric acid, polythionic acid ($H_2S_nO_6$), and other decomposition products derived from thiourea.

These thiourea-decomposed products are difficult to remove completely through a general filtration method employing filter cloth, activated carbon, ion-exchange resin, or a similar material. In order to prevent formation of thiourea-decomposed products, a compound other than thiourea is used in combination with thiourea, and this has heretofore been the only way which allows the use of thiourea. Thus, it has never been possible to mass-produce electrodeposited copper through use of thiourea as a single additive.

SUMMARY OF THE INVENTION

Figure 1:
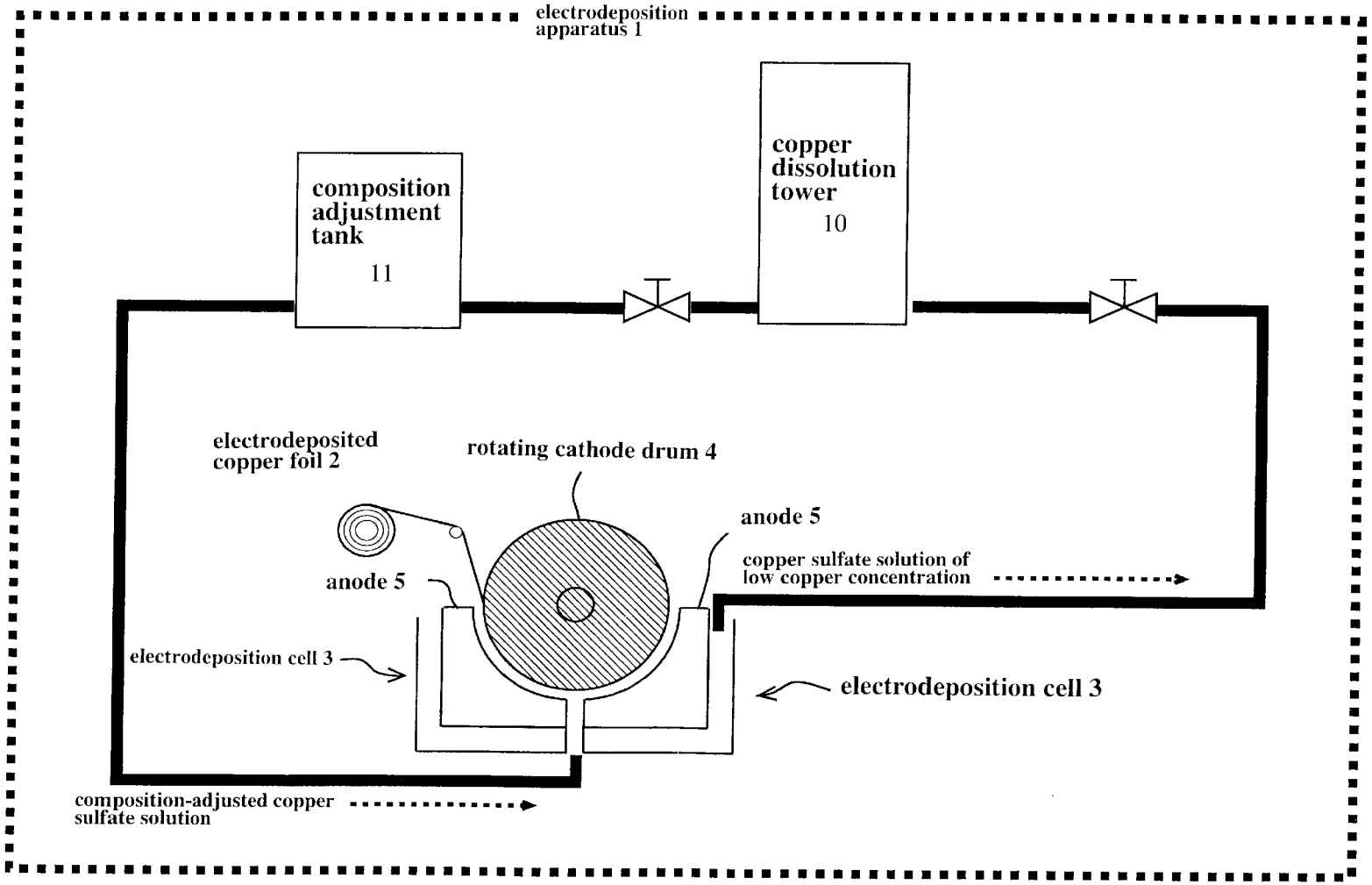
FIGS. 1 to 3 show schematic representations of the entirety of the electrodeposition apparatus employed in the present invention. In the present specification, an electrodeposition cell and a solution circulation process are also considered to be part of the "electrodeposition apparatus.

The present inventors have conducted extensive studies, and have found that thiourea-decomposed products formed in a thiourea-containing copper electrolyte can be removed from the electrolyte through modification of a conventional filtration method, and that the thiourea level of the electrolyte can be reduced to a level such that electrodeposition-completed copper electrolyte can be recycled.

It has been found that, when an electrodeposition-completed copper electrolyte is recycled in the method employed for producing electrodeposited copper foil according to the present invention, electrodeposited copper foil of interest, which has heretofore never been obtained, can be produced with uniform quality. In the present specification, an electrodeposition apparatus for performing electrodeposition in the above thiourea-containing copper electrolyte and an electrodeposited copper foil produced by use of the electrodeposition apparatus will be described.

Firstly, the electrodeposition apparatus for performing electrodeposition in a thiourea-containing copper electrolyte will be described. When electrodeposition is carried out, if thiourea-decomposed products remaining in the copper electrolyte are insufficiently removed, the products are incorporated into deposited copper as an inhibitor and deposited on the electrode surface, thereby prohibiting uniform copper electrodeposition. Thus, properties such as tensile strength, surface roughness of deposited copper, hardness, and volume resistivity greatly vary from area to area, to thereby reduce the essential quality of deposited copper foil as an industrial product.

It has conventionally been considered that these thiourea-decomposed products cannot be removed through an activated carbon treatment only, particularly during copper foil production on a large scale. From another perspective, filtration of a copper electrolyte by use of activated carbon is known to be an effective method for improving elongation of deposited copper in a high-temperature atmosphere. In order to perform continuous electrodeposition while maintaining the high-temperature elongation characteristics of deposited copper, there appears to be no alternative method that replaces the above method. In view of the foregoing, the present inventors have conducted intensive studies on a method for treating a copper electrolyte through filtration using activated carbon, which method can remove thiourea-decomposed products, and have found that the electrodeposition apparatus of the present invention can be used in a large-scale production step.

In the present specification, the term "thiourea-added or thiourea-containing copper sulfate solution" refers to either a copper sulfate solution containing thiourea alone as an additive or a copper sulfate solution containing thiourea and glue or gelatin as additives. Throughout the specification, the expression "addition or use of thiourea alone" similarly includes further addition or use of glue or gelatin. Glue or gelatin, which has historically been used as an additive for the electrolyte, is added so as to control the properties of electrodeposited copper foil obtained from a thiourea-added copper sulfate bath; e.g., to control the elongation and tensile strength of the foil or to prevent generation of micropores and pinholes in the foil.

For the sake of a better understanding of the description of the present invention, circulation paths provided in the elctrodeposition apparatus will be described briefly with reference to FIG. 1. A copper electrolyte in which electrodeposition in an electrolysis bath has been completed has a low copper concentration (in the present specification, the solution is simply referred to as "spent solution") and is discharged from the bath. The discharged spent solution, i.e. low-copper-concentration copper sulfate solution is fed to a copper dissolution tower and serves as a sulfuric acid solution for dissolving copper wire or similar material. As a result, the copper ion concentration in the spent solution is enriched, to thereby form a high-copper-concentration copper sulfate solution. The high-copper-concentration copper sulfate solution is transferred to the electrodeposition cell again and serves as an electrolyte for producing electrodeposited copper foil. In this way, the copper sulfate solution can be used repeatedly. In FIG. 1, it can be seen that the electrodeposition apparatus also includes circulation paths and a filtration path for the copper electrolyte.

Claim 1 is drawn to an electrodeposition apparatus comprising a path for circulating a copper sulfate solution, the path being provided for performing electrolyzing in an electrodeposition cell a composition-adjusted, thiourea-added copper sulfate solution, to thereby produce electrodeposited copper foil;

feeding, after completion of electrodeposition, a spent solution discharged from the electrodeposition cell to a copper dissolution tower, to thereby serve as a sulfuric acid solution for dissolving copper and prepare a high-copper-concentration copper sulfate solution;

incorporating an additive into the high-copper-concentration copper sulfate solution, to thereby prepare a composition-adjusted copper sulfate solution; and feeding the composition-adjusted copper sulfate solution to the electrodeposition cell, to thereby serve as an electrolyte again;

characterized in that, in an upstream position in relation to the copper dissolution tower where the spent solution fed from the electrodeposition cell in which electrodeposition has been completed serves as a sulfuric acid solution for dissolving copper, there is provided a circulation-filtration apparatus which enables the spent solution to undergo circulation-filtration treatment at 200–500 liters/minute for 30 minutes or longer by use of granular activated carbon in an amount of 400–500 kg.

The electrodeposition apparatus of claim 1 comprises a circulation-filtration apparatus which can remove thiourea-decomposed products, to a level such that the electrolyte can be used for continuous electrodeposition, by, after completion of electrodeposition, subjecting a copper electrolyte to circulation-filtration for a predetermined period of time by use of granular activated carbon. Although no particular limitation is imposed on the timing for performing circulation-filtration by use of activated carbon, thiourea-decomposed products are removed through circulation-filtration, preferably immediately after completion of electrodeposition. Selection of the timing is based on the following reason. As described above, the spent solution whose copper concentration has been reduced after electrodeposition is regenerated to a sulfuric acid solution for dissolving copper, to thereby prepare a high-copper-concentration copper sulfate solution. Subsequently, an additive is incorporated into the solution so as to adjust the composition of the solution, to thereby serve as an electrolyte again. The electrolyte after electrodeposition must flow through a considerably long passage. If thiourea-decomposed products remain in the long passage, retention time of the products is prolonged and the length of the path possibly having contamination increases.

Figure 2:
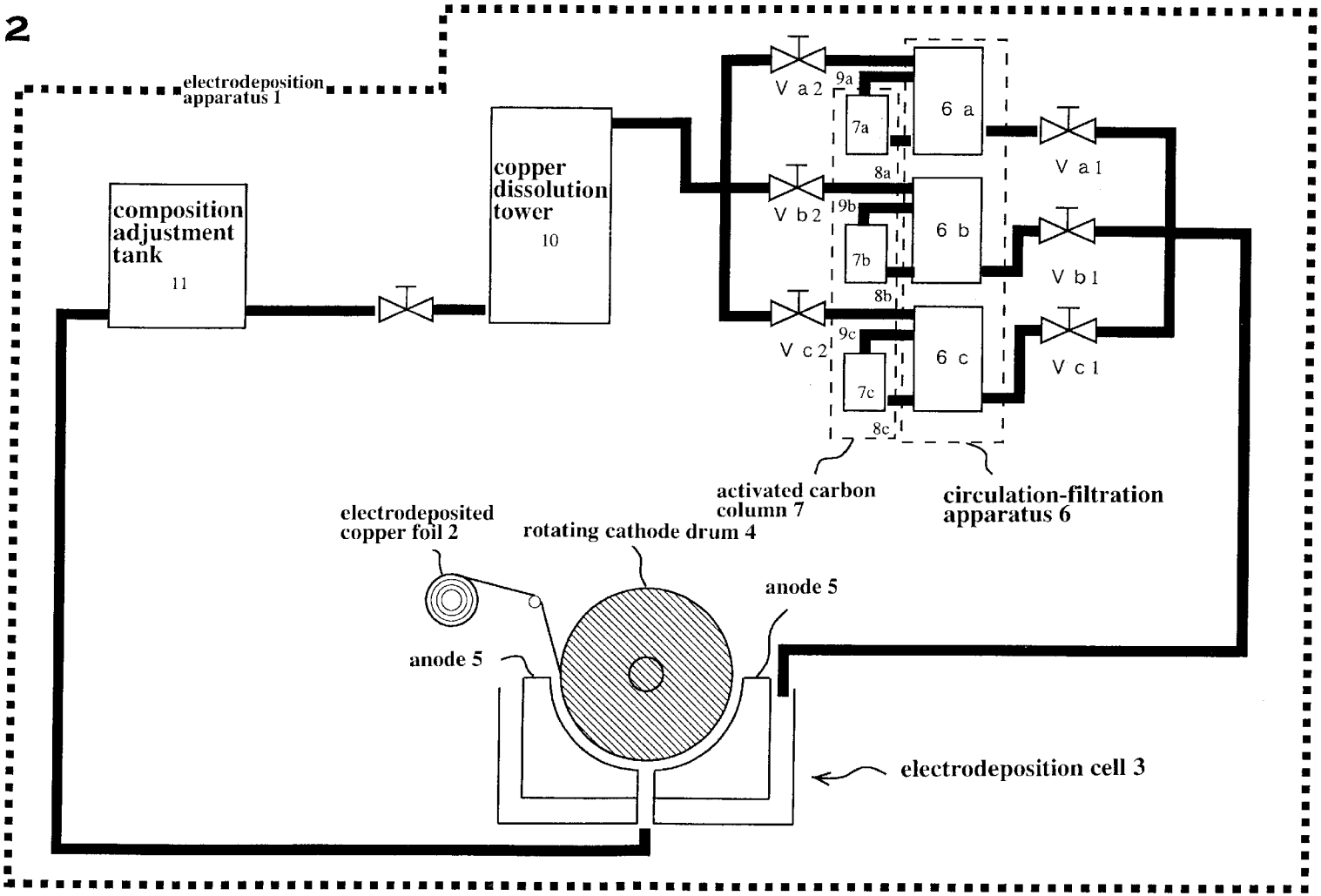

Accordingly, as shown in FIG. 2, in the apparatus of the present invention, there is provided a circulation-filtration apparatus for removing thiourea-decomposed products through circulation-filtration before the spent solution overflowing the electrodeposition cell is fed to the copper dissolution tower.

In relation to the above, the present inventors provide three circulation-filtration apparatuses within the path. The three baths must be provided so as to receive a spent solution continuously discharged through overflow thereof from the electrodeposition cell, to thereby perform circulation-filtration of the spent solution. Specifically, among these three baths, a first circulation-filtration apparatus serves as a reservoir tank for receiving, for a predetermined period of time, the spent solution overflowing the electrodeposition cell. While the bath is receiving the spent solution overflowing the electrodeposition cell, circulation-filtration may be initiated by use of an activated carbon column, to thereby enhance filtration efficiency.

A second circulation-filtration apparatus is already in the "filled state"; i.e., filled with the spent solution overflowing the electrodeposition cell. In the second apparatus, circulation-filtration is performed for 30 minutes or longer. The circulation-filtration apparatus is equipped with an activated carbon column serving as a filtration means, which comprises a bypass path for introducing the solution thereinto and another bypass path for discharging the solution. The activated carbon column is filled with granular activated carbon in an amount of 400–500 kg, and the spent solution is introduced at 200–500 liters/minute for effecting circulation-filtration. The circulation-filtration is carried out continuously for 30 minutes or longer.

As recited in claim 2, the granular activated carbon to be used in the column preferably has a particle size of 8 mesh to 50 mesh. The present inventors distinguish granular activated carbon from powdery activated carbon at the critical particle size of 50 mesh. Thus, activated carbon particles having a particle size less than 50 mesh are more suited to be called "powdery activated carbon" rather than "granular activated carbon." Powdery activated carbon can be used in the electrodeposition apparatus as recited in claim 3, since powdery activated carbon exhibits high adsorption performance with respect to thiourea-decomposed products, which granular activated carbon does not exhibit. When activated carbon particles having a particle size of more than 8 mesh are employed, solution-carbon contact interface area during the circulation-filtration decreases, to thereby fail to attain an expected level of removal of thiourea-decomposed products.

Through the aforementioned technique, thiourea-decomposed products formed by electrolysis in a copper sulfate solution can be removed to a level such that electrodeposition operation can be performed continuously. Since thiourea-decomposed products exhibit a low adsorption rate to activated carbon, thiourea has not been recognized as a possible additive that can be used alone in the actual production of electrodeposited copper foil. However, through the aforementioned technique, continuous electrodeposition by use of a thiourea-added copper sulfate solution can be realized.

The volume capacity of each circulation-filtration apparatus is determined by the volume of overflowing solution, which in turn depends on the volume of solution fed to the electrodeposition cell and the time required for circulation-filtration. Thus, the volume capacity varies in accordance with the conditions. In the electrodeposition apparatus of the present invention to be employed for producing electrodeposited copper foil, a capacity of 6,000–15,000 liters is necessary if the volume of solution introduced into the electrodeposition cell is controlled to 200–500 liters/minute per electrodeposition cell and the time for introducing the solution into the reservoir is 30 minutes, which is the minimum circulation-filtration time.

A third circulation-filtration apparatus is in such a state that circulation-filtration is completed, and at this situation, the treated solution is transferred to the copper dissolution tower. The speed of transfer must be higher than the feed speed of the spent solution flowing from the electrodeposition cell to the circulation-filtration apparatus.

Claim 3 is drawn to an electrodeposition apparatus comprising a path for circulating a copper sulfate solution, the path being provided for performing electrolyzing in an electrodeposition cell a composition-adjusted, thiourea-added copper sulfate solution, to thereby produce electrodeposited copper foil;

feeding, after completion of electrodeposition, a spent solution discharged from the electrodeposition cell to a copper dissolution tower, to thereby serve as a sulfuric acid solution for dissolving copper and prepare a high-copper-concentration copper sulfate solution;

incorporating an additive into the high-copper-concentration copper sulfate solution, to thereby prepare a composition-adjusted copper sulfate solution; and feeding the composition-adjusted copper sulfate solution to the electrodeposition cell, to thereby serve as an electrolyte again;

characterized in that, in an upstream position relative to the copper dissolution tower where the spent solution fed from the electrodeposition cell in which electrodepositon has been completed serves as a sulfuric acid solution for dissolving copper, there is provided a filtration means comprising an ultrafiltration apparatus including therein a strainer on which is formed a filtration layer formed of an filtration aid and powdery activated carbon.

Figure 3:
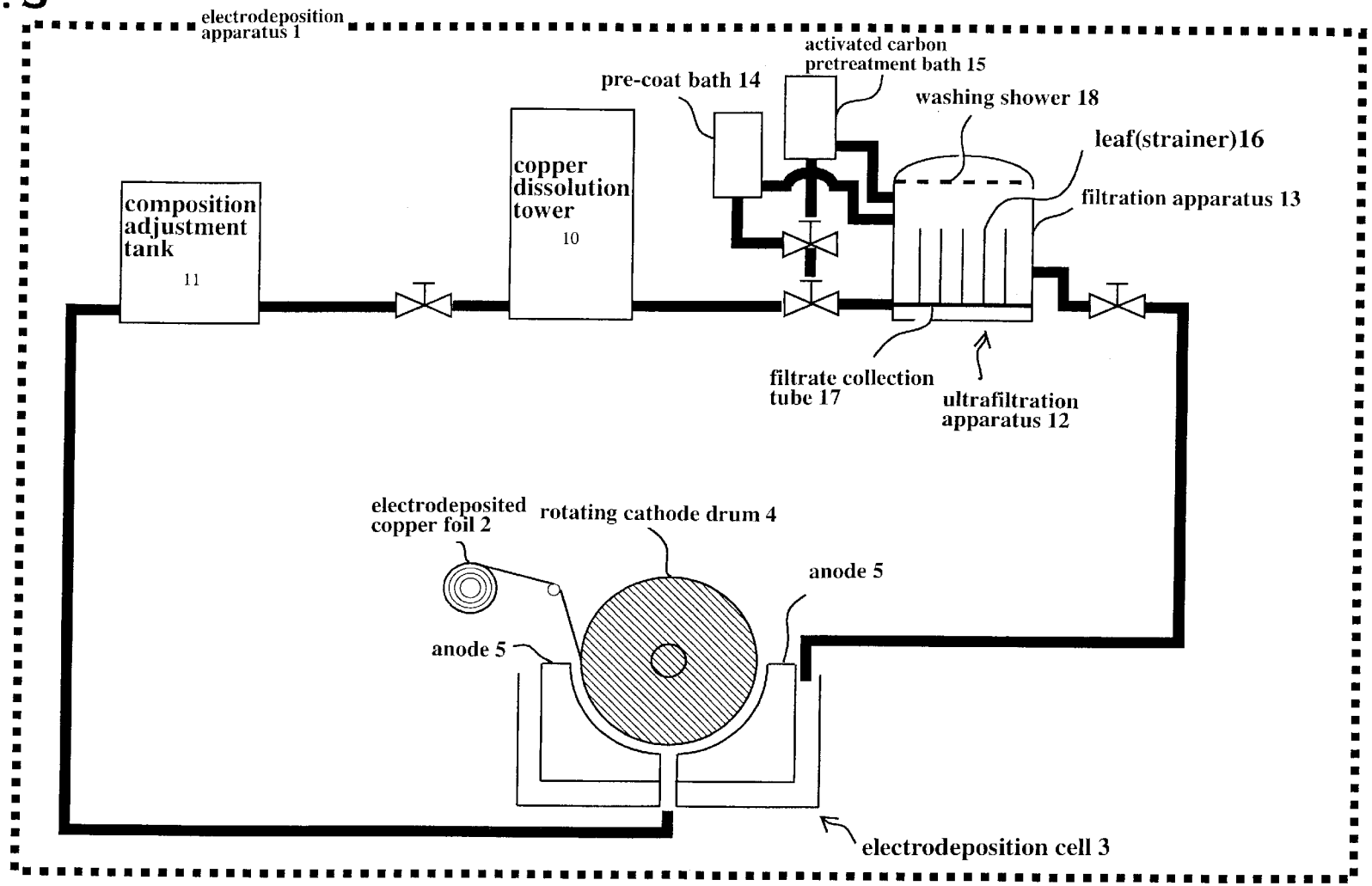

The electrodeposition apparatus recited in claim 3 comprises, in the path for circulating a copper sulfate solution, an ultrafiltration apparatus including therein a strainer on which is formed a filtration layer formed of an filtration aid and powdery activated carbon. Conventionally, ultrafiltration apparatuses have been widely used for filtering a copper sulfate solution for producing electrodeposited copper foil. In current ultrafiltration apparatuses, filtration is performed through a pre-coat method making use of a filtration aid. The pre-coat method involves pre-coating a strainer such as filtration cloth or a metallic screen with a filtration aid such as diatomaceous earth or Pearlite; passing a copper electrolyte through the strainer, to thereby deposit electrolysis by-products and impurities contained in the solution; and removing the deposited cake. FIG. 3 shows a schematic view of the electrodeposition apparatus.

This filtration method is very advantageous for the treatment of a large amount of electrolyte, in that the method causes no plugging over long-term operation and attains high-efficiency filtration. Thus, the method is widely used. In addition, through the method, filtration can be advantageously performed in accordance with the size of matter to be removed, by appropriately selecting properties of the filtration aid such as type and particle size.

However, when a filtration aid is used singly in the pre-coat method, electrolysis by-products and stained matter of small particle size cannot be removed. Furthermore, when the particle size of the filtration aid is reduced so as to remove matter such as electrolysis by-products of small particle size, filtration efficiency decreases considerably; i.e., solution penetration becomes poor. Thus, reduction of the particle size is not preferable in practical operation.

From another viewpoint, a filtration method using activated carbon is known to be effective for removing electrolysis by-products and stained matter of small particle size. Activated carbon, having excellent adsorption performance, is suitable for removing matter such as electrolysis by-products of small particle size. In addition, when a copper electrolyte is treated with activated carbon, physical properties of electrodeposited copper obtained from the electrolyte can also be controlled. Thus, the method is employed in production of electrodeposited copper foil.

The present inventors have considered application to removal of thiourea-decomposed products remaining in a copper sulfate solution of a method which can provide advantages of both the pre-coat method and activated carbon.

In a typical manner, activated carbon is charged in an activated carbon column in which perforated plates are provided, and a copper electrolyte is passed through the column for treatment. Through this method, electrolysis byproducts and stained matter of small particle size can be effectively removed. However, when filtration of the solution is performed for a long period of time, the distribution of activated carbon filled in the column is changed, to thereby generate a portion where solution flows easily and a portion where solution flows with difficulty. As a result, localized flow is generated in the column, to thereby reduce the area of contact interface between activated carbon and the copper electrolyte and thus reduce the purification effect. In addition, in the method employing the activated carbon column, granular activated carbon is typically used.

When the activated carbon column is used, an excess amount of activated carbon must be charged into the column so as to ensure filtration by use of activated carbon, to thereby assure a sufficient contact area between the solution and activated carbon and a sufficient contact time. Use of activated carbon in an excess amount results in an increase in costs for apparatus and maintenance thereof, thereby disadvantageously elevating production costs.

Furthermore, the most effective method for increasing area of contact interface between solution and activated carbon is use of activated carbon having a small particle size; i.e., powdery activated carbon. However, when powdery activated carbon is used in an activated carbon column, pressure loss of the solution introduced to the column increases, to thereby cause frequent plugging. Thus, treatment as in the case in which granular activated carbon is employed is difficult to attain. Accordingly, in normal cases, there must be employed batch treatment, in which powdery activated carbon is added directly to a bath filled with a solution, and the mixture is stirred. Batch treatment is not preferably applied to a step of continuous electrodeposition of copper.

In view of the foregoing, the present inventors have considered that powdery activated carbon is caused to be trapped by a pre-coat layer which is formed on a surface of a strainer involved in an ultrafiltration apparatus. Through this method, thiourea-decomposed products can be removed by use of powdery activated carbon through one course of treatment, thereby attaining continuous treatment of a copper electrolyte.

As recited in claim 5, the powdery activated carbon to be used in the method according to the present invention for filtering a copper electrolyte preferably has a particle size of 50 mesh or under, more preferably 50–250 mesh. In the description provided hereinabove with respect to granular activated carbon, activated carbon having a particle size of 50 mesh is categorized as granular activated carbon. However, since the 50-mesh activated carbon can be used in either the method as recited in claim 1 or that recited in claim 3, the activated carbon is also categorized as powdery activated carbon. When activated carbon has a particle size of 50 mesh over (i.e., larger particles), the area of contact interface among activated carbon particles decreases, to thereby fail to attain removal of thiourea-decomposed products through one course of filtration, whereas activated carbon having a particle size of 250 mesh under (i.e., smaller particles) readily causes plugging-like phenomena, to thereby increase pressure-loss of solution and reduce the flow-out rate. Thus, trapping activated carbon requires a long period of time. Accordingly, the particle size of activated carbon used in practice is preferably 50–250 mesh, in view of filtration efficiency and costs.

Figure 4A:
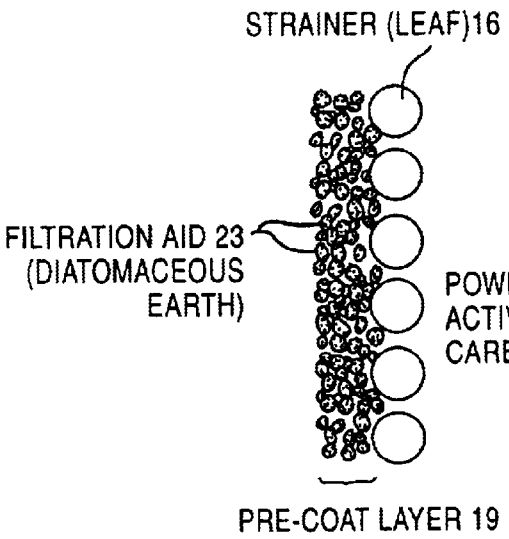
" FIGS. 4(*a*) and 4(*b*) are schematic representations showing a state in which activated carbon is trapped by a filtering aid layer formed on strainers used in the ultrafiltration apparatus.
Figure 4B:
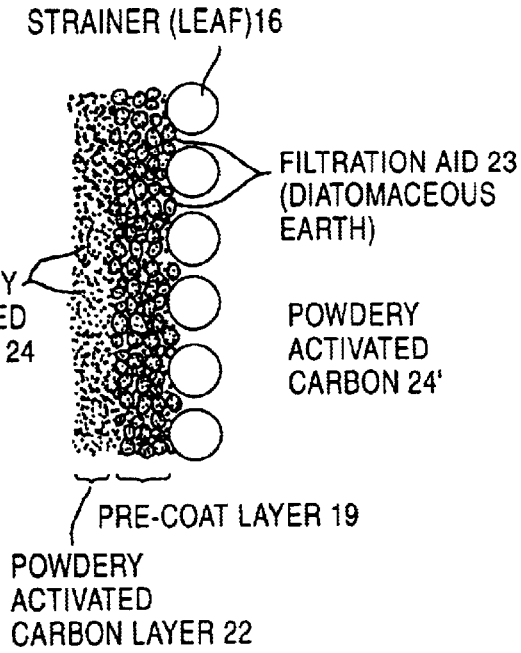

With reference to FIG. 4, there will next be described a pre-coat layer to be formed on a surface of a strainer included in an ultrafiltration apparatus, and a method for trapping powdery activated carbon in the pre-coat layer. The pre-coat layer is formed by affixing a filtration aid of predetermined thickness on a surface of a strainer.

Figure 5:
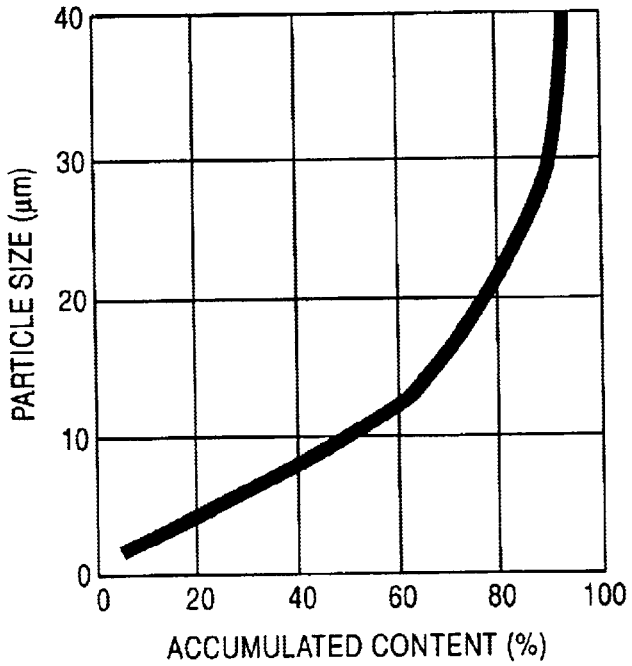
FIG. 5 is a graph showing particle size distribution of a filtration aid.

Any generally known filtration aid, such as diatomaceous earth, Pearlite, or cellulose, which exhibits a particle size distribution as shown in FIG. 5, can be used. Filtration cloth, a metallic screen, and other porous materials may be used as the strainer according to the present invention, so long as these materials can retain a filtration aid and filtrate pressurized solution. When a pre-coat layer is formed on a strainer by use of the aforementioned filtration aid, micro-scale network passages which allow a copper electrolyte to pass are generated inside the pre-coat layer.

The appropriate thickness of the pre-coat layer is 5 mm to 50 mm. The thickness of the pre-coat layer is in proportion to the amount of powdery activated carbon trapped in the layer. Accordingly, when the thickness is less than 5 mm, thiourea-decomposed products cannot be removed sufficiently by one course of filtration, whereas when the thickness is in excess of 50 mm, efficiency of removal of thiourea-decomposed products does not increase commensurate with the increase in thickness.

As recited in claim 7, a preferably used filtration aid comprises diatomaceous earth having a particle size of 3–40 $\mu$m and is formed by mixing diatomaceous earth having a particle size of 3–15 $\mu$m and diatomaceous earth having a particle size of 16–40 $\mu$m at a proportion of 7:3. The reason for using two types of diatomaceous earth differing in particle size distribution is that the packing density of diatomaceous earth in the pre-coat layer is elevated by intruding diatomaceous earth particles having a small size into spaces defined by diatomaceous earth particles having a large size, to thereby enhance efficiency of trapping activated carbon performed in a later step. The present inventors have investigated the combination of diatomaceous earth powders having a variety of particle size, and have found that effective trapping of powdery activated carbon can be attained "by mixing diatomaceous earth having a particle size of 3–15 $\mu$m and diatomaceous earth having a particle size of 16–40 $\mu$m at a proportion of 7:3," and that the thus-produced mixture is the most suitable filtration aid even when pressure loss of solution to be fed to an ultrafiltration apparatus is taken into consideration.

By use of such a filtration aid, the pre-coat layer is formed on a strainer through a customary technique. More specifically, the pre-coat layer is formed by the following steps: introducing to an ultrafiltration apparatus including a strainer therein a solution containing the aforementioned diatomaceous earth from a bath containing the solution (hereinafter referred to as "pre-coat bath"); and pressurizing a surface of the strainer at a predetermined pressure, to thereby deposit diatomaceous earth on the surface of the strainer. During deposition, the solution leaves diatomaceous earth on the strainer; passes through the surface of the strainer; flows into a solution-collection tube; and is discharged through a solution discharge tube. In general, an ultrafiltration apparatus includes a plurality of strainers therein, and a solution flowing into the apparatus is filtered through a plurality of strainers.

No particular limitation is imposed on the composition of the solution containing diatomaceous earth for forming a pre-coat layer, and the solution to be used may be selected from a copper electrolyte to be filtered, a diluted solution thereof, and water, on the basis of advantage in process control.

After completion of disposition of strainers in the ultrafiltration apparatus, powdery activated carbon is trapped in the pre-coat layer. Similar to the case in which diatomaceous-earth-containing solution is introduced to the filtration apparatus, trapping is performed by introducing to an ultrafiltration apparatus in which a pre-coat layer is formed a solution containing powdery activated carbon (hereinafter referred to as "activated carbon pre-treatment solution") from a bath containing the solution (hereinafter referred to as "activated carbon pre-treatment bath"). Throughout the specification, the term "powdery activated carbon" refers to activated carbon having a small particle size as compared with the aforementioned granular activated carbon.

Similar to the diatomaceous-earth-containing solution for forming a pre-coat layer, no particular limitation is imposed on the composition of the solution serving as an activated carbon pre-treatment solution, and the solution to be used may be selected from a copper electrolyte to be filtered, a diluted solution thereof, and water, on the basis of advantage in process control. Briefly, any activated carbon pre-treatment solution may be used, so long as the solution does not cause contamination of the copper electrolyte by a component of the solution during filtration by passing a copper electrolyte through strainers after formation of powdery activated carbon thereon and does not affect a further electrodeposition step.

As shown in FIG. 4(*a*), a pre-coat layer formed on strainers comprises diatomaceous earth serving as a filtration aid and contains network-like passages. Thus, a portion of powdery activated carbon introduced into the ultrafiltration apparatus intrudes the network-like passages, and powdery activated carbon particles which cannot intrude the passages are deposited on the pre-coat layer, thereby forming a powdery activated carbon layer. At an early stage of introduction of the activated carbon pre-treatment solution, a predominant amount of powdery activated carbon passes through the pre-coat layer and is discharged from the ultrafiltration apparatus. However, as this operation is repeated, the network-like passages in the pre-coat layer are gradually plugged with powdery activated carbon, with the result that leakage of powdery activated carbon decreases. With further continuous circulation, leakage of powdery activated carbon stops, and the solution passes selectively. At this stage, trapping of powdery activated carbon in the pre-coat layer is completed, as shown in FIG. 4(*b*).

In the present invention, a plurality of layers in which pre-coat layers and powdery activated carbon layers are alternately stacked can be formed by alternately repeating formation of a pre-coat layer and trapping of powdery activated carbon. Such a multi-layer structure enables to elevate filtration efficiency of thiourea-decomposed products; readily elevate the amount of trapped activated carbon; and finely control solution purification performance. In other words, the stacking conditions of the pre-coat layers and the powdery activated carbon layers may be determined in accordance with the amount of thiourea to be added to a copper electrolyte, the amount of thiourea-decomposed products to be formed, and similar parameters. In addition, the number of the layers to be stacked and the overall thickness of the layer may be appropriately determined in view of filtration efficiency; i.e., ease of passage of copper electrolyte.

As recited in claim 6, the powdery activated carbon layer to be formed in the method for filtering a copper electrolyte according to the present invention preferably has a thickness of 5–20 mm. When the thickness is less than 5 mm, removal of electrolysis by-products and stained matter of small particle size tends to be attained insufficiently, whereas when the thickness is in excess of 20 mm, filtration efficiency; i.e., ease of passage of copper electrolyte, decreases, thereby cause a disadvantageous cost problem.

Through the aforementioned method for filtering a copper electrolyte according to the present invention, when electrodeposition is performed by use of thiourea as an additive for controlling physical properties of deposited copper, thiourea-decomposed products can be effectively removed and a clean copper electrolyte can be regenerated. Thus, according to the present invention, deposited copper products exhibiting specific physical properties can be produced continuously, even when thiourea alone is used during continuous electrodeposition of copper.

Moreover, an additional use of a body-feed method—in which powdery activated carbon is added directly to the spent solution which has not yet been filtered by means of the aforementioned ultrafiltration apparatus—is also remarkably effective for removing thiourea-decomposed products. A variety of specific techniques can be employed in the body-feed method. For example, a copper sulfate solution to which powdery activated carbon has been added in advance is fed with pressure to a pipe for circulating spent solution. Alternatively, a body-feed bath to which powdery activated carbon is added with stirring is attached to a pipe extending from an electrodeposition cell to an ultrafiltration apparatus, to thereby mingle powdery activated carbon with spent solution. By use of the aforementioned electrodeposition apparatus, thiourea remaining in an electrolyte at a concentration of 6 ppm or less can be removed effectively. Even when the thiourea concentration is in excess of 6 ppm, complete removal thereof can be attained by prolonging circulation time; by means of increasing the number of strainers in a larger filtration apparatus, or by means of providing an additional filtration step in a path of the electrodeposition apparatus according to the present invention.

Through the aforementioned electrodeposition method, electrodeposited copper foil exhibiting the following characteristics, which has never been obtained through conventional method, can be produced on a large scale. In claim 8, there is provided electrodeposited copper foil obtained through electrolysis of a thiourea-added copper sulfate solution, characterized by exhibiting a high resistivity, as measured in a foil without surface treatment, of 0.190–0.210 Ω-g/m$^2$ for a nominal thickness of 3 $\mu$;

0.180–0.195 Ω-g/m$^2$ for a nominal thickness of 9 $\mu$;

0.170–0.185 Ω-g/m$^2$ for a nominal thickness of 18 $\mu$; and 0.170–0.180 Ω-g/m$^2$ for a nominal thickness of 35 $\mu$ or more, and by assuming a low-profile surface having an average surface roughness (Ra) of 0.1–0.3 $\mu$m.

The high-resistivity copper foil can be produced with controlling resistivity on a large scale on the basis of realization of continuous and constant electrolysis by use of a thiourea-containing copper electrolyte. The resistivity values listed above are as measured in accordance with a method defined in IPC standards TM-650 2.5.14, which is a method generally employed for measuring resistivity of copper foil for producing printed wiring boards.

Resistivity of copper foil for producing printed wiring boards is measured in accordance with IPC standards MF-150F 3.8.1.2. Rated values are 0.181 Ω-g/m$^2$ for a nominal thickness of 3$\mu$; 0.171 Ω-g/m$^2$ for a nominal thickness of 9$\mu$; 0.166 Ω-g/m$^2$ for a nominal thickness of 18$\mu$; and 0.162 Ωg/M$^2$ for a nominal thickness of 35$\mu$ or more. When compared with these values rated in IPC standards MF-150F, the resistivity of the high-resistivity electrodeposited copper foil is higher by approximately 10–20%. However, note that, since IPC standards MF-150F defines the thickness of copper foil as the weight per unit area, the thickness is, in a strict sense, different from the nominal thickness.

The electrodeposited copper foil obtained by electrolysis of a thiourea-added copper sulfate solution exhibits a remarkably dense microstructure in which crystal grain boundaries cannot be detected clearly under an optical microscope at a magnification of approximately 1000. Accordingly, the electrolysis can impart, to electrodeposited copper foil, an effect equivalent to reduction in the size of crystal grains. Specifically, the electrodeposited copper foil exhibits a tensile strength as high as approximately 80 kg/mm$^2$, a Vicker's hardness as high as 150 Hv to 220 Hv, and a surface roughness (Rz) as small as 0.3–2.0 $\mu$m. The present inventors have further investigated an increased number (N) of specimens, and have found that the surface roughness (Rz) can be reliably controlled to 0.7–1.2 $\mu$m. Such level of surface roughness cannot be attained reliably for electrodeposited copper foil obtained through a customary method.

The high-resistivity electrodeposited copper foil according to the present invention, having high tensile strength and Vicker's hardness, is very advantageous for serving as TAB material. TAB is produced through a method including forming ultramicro-circuits by use of electrodeposited copper foil and bonding IC devices to an inner lead produced from the same copper foil, to thereby effect mounting. When the tensile strength of the electrodeposited copper foil is low, an inner lead portion formed of copper foil extends due to bonding pressure, to disadvantageously deform the shape of IC devices, whereas when the tensile strength is high, such drawbacks can be overcome and high bonding pressure can be applied, to thereby enhance reliability of connection between an IC device and an inner lead.

The electrodeposited copper foil according to the present invention has a very smooth surface having a surface roughness (Rz) of 0.3–2.0 $\mu$m. Such copper foil is categorized as very low-profile copper foil and has characteristics suitable for forming fine-pitch circuits. The characteristics are provided by copper-clad laminate produced from low-profile copper foil. The present invention will next be described in more detail with reference to the following embodiments for carrying out the invention.

BEST MODE FOR CARRYING OUT THE INVENTION

Embodiments of the present invention will next be described. The embodiments will be described by taking, as an example, production of electrodeposited copper foil through a process in which a copper sulfate electrolyte is used, a solution of thiourea (20 g/l) is added to the electrolyte, and the concentration of thiourea in the electrolyte is controlled such that the concentration falls within a range of 3.5–5.5 ppm.

First embodiment: Electrodeposited copper foil 2 having a resistance as high as 0.170–0.185 Ω-g/m$^2$ (for a nominal thickness of 18$\mu$) is produced by use of an electrodeposition apparatus 1 shown in FIG. 2. A rotataing cathode drum 4 and anodes 5 are provided in an electrodeposition cell 3 shown in FIG. 2, and a composition-adjusted copper sulfate solution containing thiourea is supplied to a space between the rotataing cathode drum 4 and the anodes 5 at a rate of 300 liters per minute. During supply of the solution, a copper component is electrodeposited on the surface of the rotataing cathode drum 4 through electrolysis, and the thus-produced electrodeposited copper foil 2 having a predetermined thickness is taken up. After completion of electrolysis, the resultant copper sulfate solution in which the concentration of copper is low (i.e., spent solution) overflows the electrodeposition cell 3.

The spent solution which has overflowed the electrodeposition cell 3 is fed to a circulation-filtration apparatus 6 for subjecting thiourea-decomposed products to circulation-filtration to thereby remove the products. Strictly speaking, the circulation-filtration apparatus 6 includes three baths.

The spent solution which has overflowed the electrodeposition cell 3 is fed to a circuration-filtration apparatus 6*a* by closing valves $V_{b1}$, $V_{c1}$, and $V_{a2}$ and opening a valve $V_{a1}$. The combined volume of three circuration-filtration apparatuses 6*a*, 6*b*, and 6*c* is about 10,000 liters, and the circuration-filtration apparatuses 6*a*, 6*b*, and 6*c* are equipped with activated carbon columns 7*a*, 7*b*, and 7*c*, respectively. Therefore, the circuration-filtration apparatuses 6*a*, 6*b*, and 6*c* are equipped with feeding bypass paths $\mathbf{8}_a$, $\mathbf{8}_b$, and $\mathbf{8}_c$, respectively, for feeding the solution to the activated carbon columns 7*a*, 7*b*, and 7*c*. The circuration-filtration apparatuses 6*a*, 6*b*, and 6*c* are also equipped with discharge bypass paths $\mathbf{9}_a$, $\mathbf{9}_b$, and $\mathbf{9}_c$, respectively, for discharging from the activated carbon columns 7*a*, 7*b*, and 7*c* the solution which has undergone filtration. The respective activated carbon columns 7*a*, 7*b*, and 7*c* are filled with powdery activated carbon (500 kg) having a particle size of 8–50 mesh. The copper sulfate solution is fed to the activated carbon columns 7*a*, 7*b*, and 7*c* at a flow rate of 300 liters per minute.

The circuration-filtration apparatus 6*a* was used for 30 minutes as a reservoir tank for receiving the spent solution which had overflowed the electrodeposition cell 3. While the copper sulfate solution was received by the circuration-filtration apparatus 6*a*, filtration of the solution was initiated by use of the activated carbon column 7*a*.

The circuration-filtration apparatus 6*b* was filled with the overflowed spent solution, and the solution was subjected to circulation-filtration for 30 minutes by use of the activated carbon column 7*b*. During circulation-filtration, the valves $V_{b1}$ and $V_{b2}$ were closed.

In the circuration-filtration apparatus 6*c*, circulation-filtration of the solution was completed. The solution which had undergone treatment with activated carbon was fed to a copper dissolution tower 10 by closing the valve $V_{c1}$ and opening the valve $V_{c2}$. The solution was fed at a rate of 500 liters per minute.

When the circuration-filtration apparatus 6*c* is evacuated, feeding of the spent solution to the circuration-filtration apparatus 6*a* is stopped by closing the valve $V_{a1}$, and the solution is fed to the circuration-filtration apparatus 6*c* by opening the valve $V_{c1}$. In the circuration-filtration apparatus 6*a*, the solution is subjected to circulation-filtration for 30 minutes by use of the activated carbon column 7*a*. Feeding of the spent solution which has undergone filtration from the circuration-filtration apparatus 6*b* to the copper dissolution tower 10 is initiated. Thus, the functions of the respective circuration-filtration apparatuses 6*a*, 6*b*, and 6*c* are exchanged.

The spent solution which has undergone filtration is fed from any of the circuration-filtration apparatuses 6*a*, 6*b*, and 6*c* to the copper dissolution tower 10 via the corresponding one of the valves $V_{a2}$, $V_{b2}$, and $V_{c2}$. Special-grade copper wire serving as a dissolution source was placed in the copper dissolution tower 10, and the spent solution was showered onto the copper wire while air was blown through the bottom of the tower 10, to thereby dissolve the copper wire in the solution and obtain a copper sulfate solution of high copper concentration.

The copper sulfate solution of high copper concentration was fed to a composition adjustment tank 11, fresh thiourea was added to the adjustment tank 11, and the concentration of the thiourea in the solution was adjusted to 3.5–5.5 ppm, to thereby obtain a composition-adjusted copper sulfate solution. The composition-adjusted copper sulfate solution was introduced into the electrodeposition cell 3, to thereby carry out continuous production of the electrodeposited copper foil 2.

The concentration of thiourea was obtained through high-performance solution chromatography analysis. The analysis was carried out under the following conditions: column: #3020 (4.6 mm (inner diameter)×500 mm) (product of Hitachi Ltd.), mobile phase: 10 mM urea solution, flow rate: 1 ml/min., sample injection amount: 20 $\mu$l, detector: SPD-10AVP (product of Shimadzu Corporation) at UV 237 nm and 0.02 aufs, column oven temperature: 40° C. Through the analysis, a copper electrolyte component and thiourea were separated from each other, and the concentration of thiourea was measured on the basis of a previously prepared calibration curve. In the below-described embodiment, the concentration of thiourea is measured in a manner similar to that described above.

The electrodeposited copper foil (nominal thickness: 18 $\mu$) produced through the aforementioned process has a resistance as high as 0.180 Ω-g/m$^2$, a tensile strength of 78 kgf/mm$^2$, a Vicker's hardness (Hv) of 180, and a surface roughness (Ra) of 0.02 $\mu$m on the deposition side which is not brought into contact with the rotataing cathode drum during electrolysis.

Second embodiment: The procedure of the second embodiment is the same as that of the first embodiment, except for the process for the filtration of thiourea-decomposed products. Therefore, only the filtration process for thiourea-decomposed products will next be described, and repeated description will be omitted. To the extent possible, the second embodiment will be described by use of the same reference numerals as used in the first embodiment. Electrodeposited copper foil 2 having a resistance as high as 0.170–0.185 Ω-g/m$^2$ (in the case of a nominal thickness of 18 $\mu$) was produced by use of an electrodeposition apparatus 1 shown in FIG. 3.

Figure 6:
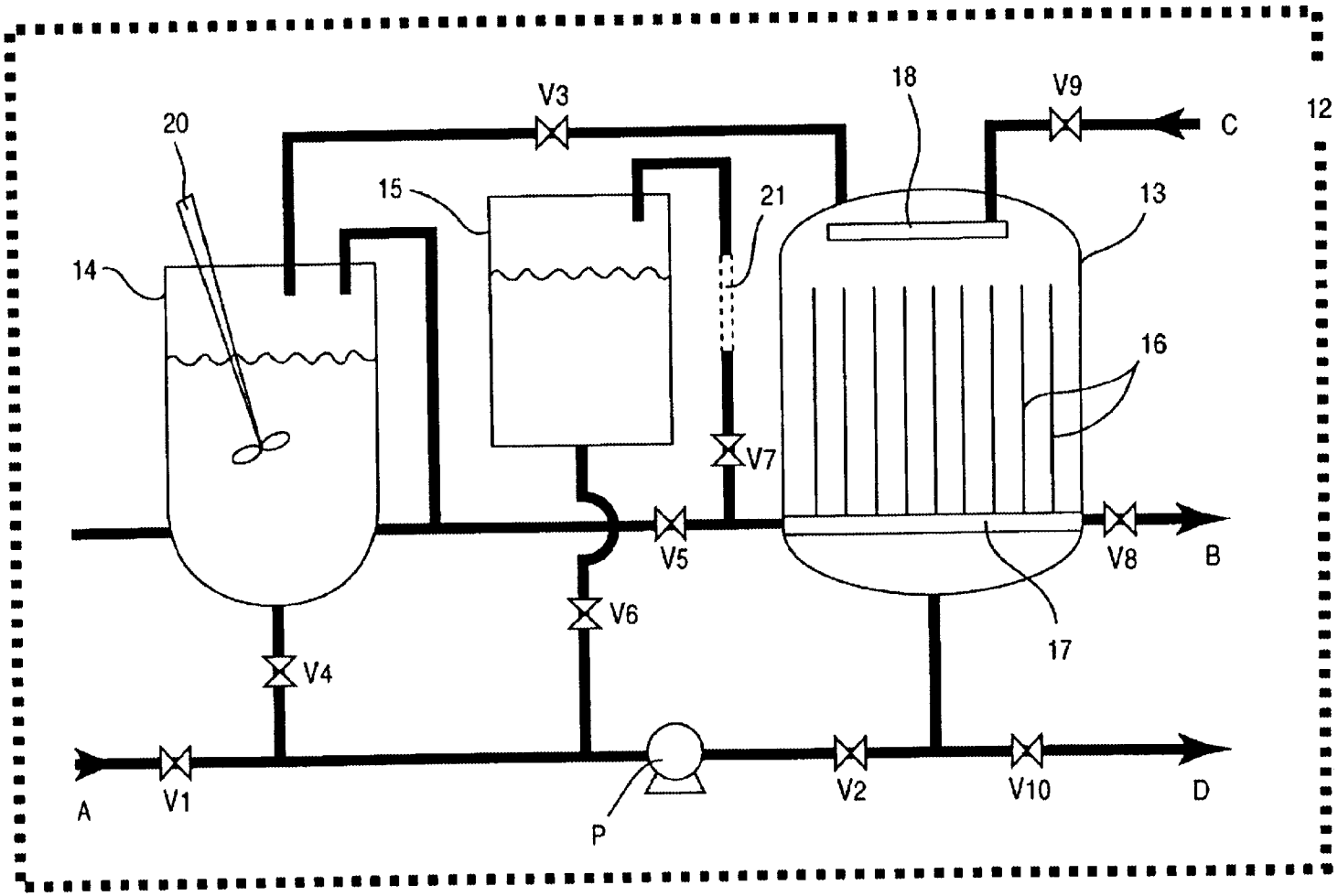
FIG. 6 shows a schematic representation of an ultrafiltration apparatus.

FIG. 6 is an enlarged schematic representation showing only an ultrafiltration apparatus according to the second embodiment. The ultrafiltration apparatus 12 includes a filtration apparatus 13, a pre-coat bath 14, an activated carbon pretreatment bath 15, and a feed pump P, which components are connected to one another via pipes. Valves (V1 to V10) are appropriately provided in the pipes. A spent solution (i.e., the target for filtration) is introduced into the filtration apparatus 13 through an inlet A, and a spent solution which has undergone clarification in the filtration apparatus 13 is fed through an outlet B to a copper dissolution tower 10.

The ultrafiltration apparatus 12 is of so-called vertical ultrafilter type. The filtration apparatus 13 includes stainless-made wire netting leaves 16, serving as strainer, and a filtrate collection tube 17, the leaves 16 and the filtrate collection tube 17 being connected so as to secure a filtration path. Therefore, the spent solution fed to the filtration apparatus 13 penetrates the surfaces of the leaves 16 and passes through the interior thereof, and is gathered in the filtrate collection tube 17. The filtration apparatus 13 also includes pipes connected to the pre-coat bath 14 and the activated carbon pretreatment bath 15, and a washing shower 18 which is provided above the leaves 16.

Firstly, a pre-coat layer 19 was formed. Diatomaceous earth (product name: Celite, product of Johns Manville), which is called Hyflo Super Cel, was used as a filtration aid 23. A variety of diatomaceous earth products (e.g, Radiolite, Zemlite, or Dikalite) may be used as the filtration aid 23. Of these, diatomaceous earth which is called Hyflo Super Cel was used in the present embodiment. FIG. 5 shows the particle size distribution of Hyflo Super Cel. Hyflo Super Cel consists of diatomaceous earth having a particle size of 3–40 $\mu$m, in which diatomaceous earth having a particle size of 3–15 $\mu$m and diatomaceous earth having a particle size of 16–40 $\mu$m are mixed in a ratio of about 7:3.

In the ultrafiltration apparatus 12 of the second embodiment, pre-coating was carried out through the following procedure. Firstly, the feed pump P was driven, and a spent solution was introduced from the inlet A, through the valve V1, the feed pump P, the valve V2, the filtration apparatus 13, and the valve V3, successively, into the pre-coat bath 14. The pre-coat bath 14 was filled with the spent solution (10,000 liters). Subsequently, Hyflo Super Cel (100 kg) was added to the pre-coat bath 14, and was circulated through the pre-coat bath 14, the valve V4, the feed pump P, the valve V2, the filtration apparatus 13, and the valve V3, successively, and then dispersed in the copper sulfate electrolyte. In order to disperse the Hyflo Super Cel in the solution rapidly and reliably, a stirring apparatus 20 provided with the pre-coat bath 14 is used. The solution in which the Hyflo Super Cel was dispersed was circulated through the pre-coat bath 14, the valve V4, the feed pump P, the valve V2, the filtration apparatus 13, the leaves 16, the filtrate collection tube 17, and the valve V5, successively, to thereby deposit the Hyflo Super Cel onto the surface of filter cloth of the leaves 16 and form the pre-coat layer 19 as shown in FIG. 4 (specific gravity: 0.2 g/cm$^3$, thickness: 5 mm).

After formation of the pre-coat layer of predetermined thickness, an activated carbon pretreatment solution containing the aforementioned powdery activated carbon is circulated through the activated carbon pretreatment bath 15, the valve V6, the feed pump P, the valve V2, the filtration apparatus 13, the leaves 16, the filtrate collection tube 17, and the valve V7, successively, to thereby trap the powdery activated carbon. In this case, the circulating solution is observed visually through a transparent pipe portion 21 formed from a transparent material and provided in the vicinity of the valve V7, to thereby verify whether or not the powdery activated carbon penetrates and leaks through the pre-coat layer, the filter cloth, and the leaves. When the powdery activated carbon leaks through any of these, the circulating dilute copper sulfate solution is observed as a black turbid solution. In accordance with reduction in leakage of the activated carbon, turbidity of the solution decreases. The solution is circulated until it is observed as a clear blue solution.

FIG. 4 shows a schematic representation of a cross-section of the pre-coat layer 19 and the powdery activated carbon layer 22 produced as described above. As shown in FIG. 4(*a*), the filtration aid 23 (diatomaceous earth) is deposited onto the surface the strainer (wire net) 16, to thereby form the pre-coat layer 19. Subsequently, through circulation of the activated carbon pretreatment solution, as shown in FIG. 4(*b*), the powdery activated carbon 24 is deposited onto the surface of the pre-coat layer 19, to thereby form the powdery activated carbon layer 22. Immediately after initiation of circulation of the activated carbon pretreatment solution, as shown in FIG. 4(*a*), some of the powdery activated carbon 24 penetrates through particles of the filtration aid 23, and leaks out. However, after the solution is circulated repeatedly, as shown in FIG. 4(*b*), the amount of the powdery activated carbon 24 deposited onto the particles gradually increases, and the amount of the activated carbon 24 which leaks out gradually decreases. As a result, the powdery activated carbon layer 22 is formed.

After no leakage of the powdery activated carbon 24 was confirmed, the spent solution (i.e., the target for filtration) was introduced from the inlet A of the filtration apparatus 13, through the valve V1, the feed pump P, the valve V2, the filtration apparatus 13, the leaves 16, the collection tube 17, and the valve V8, successively, to the outlet B, to thereby carry out filtration of the solution.

After completion of predetermined filtration, thiourea-decomposed products and other electrolysis by-products contained in the copper sulfate solution are deposited in the form of cake. When the pressure for feeding of the copper sulfate solution is elevated to a predetermined control value, the cake is discharged. In this case, feeding of the spent solution (i.e., target for filtration) is stopped, and deionized water, serving as rinsing water, is introduced into the filtration apparatus 13, through a rinsing water inlet C, the valve V9, and the shower 18, successively, to thereby carry out discharge of the cake. The cake rinsed off by the water is discharged through the valve V10 and a drain outlet D.

Example data in relation to filtration efficiency in the second embodiment will next be described. In the case in which the volume of the filtration bath is 6 m$^3$, and the combined surface area of the leaves is 60 m$^2$, when the amount of employed powdery activated carbon (density: approximately 0.3–0.5×10$^3$ kg/m$^3$) is 200 kg, the thickness of the powdery activated carbon layer is about 6–11 mm. In this case, when the flow rate of the copper sulfate solution (i.e., the target for filtration) is 500 liters/minute, the time during which the solution penetrates the activated carbon layer is about 45–80 seconds.

The electrodeposited copper foil (nominal thickness: 18 $\mu$) produced through the aforementioned process has a resistance as high as 0.176 Ω-g/m$^2$, a tensile strength of 78 kgf/mm$^2$, a Vickers hardness (Hv) of 185, and a surface roughness (Ra) of 0.02 $\mu$m on the deposition side which is not brought into contact with the rotataing cathode drum during electrolysis.

According to the filtration process described in the first and second embodiments, a long contact time can be attained. Since a thin, powdery activated carbon layer is formed on the entire surface of a leaf, the contact interface area of each activated carbon particle is effectively utilized when a copper sulfate solution is brought into contact with the activated carbon layer. Therefore, even when the copper sulfate solution is subjected to one course of filtration, thiourea-decomposed products contained in the solution are effectively adsorbed onto the activated carbon and removed.

Thiourea, serving as an additive to a copper sulfate solution, enables control of surface smoothness of electrodeposited copper foil. Conventionally, when thiourea is added to a copper sulfate electrolyte and electrodeposited copper foil is produced, surface smoothness of the resultant copper foil is impaired with passage of time, although the copper foil exhibits excellent surface smoothness immediately after production thereof. However, according to the filtration process of the embodiments, thiourea-decomposed products can be satisfactorily removed through filtration, and electrodeposited copper foil exhibiting surface smoothness and specific characteristics can be continuously produced.

EFFECTS OF THE INVENTION

As described above, according to the present invention, thiourea-decomposed products contained in a copper sulfate solution to which thiourea has been added can be easily removed after completion of electrodeposition, and electrodeposited copper foil exhibiting specific characteristics—such copper foil cannot be mass-produced conventionally—can be continuously produced through continuous operation.

What is claimed is:

1. A method for the continuous production of electrodeposited copper foil while removing thiourea-decomposed products remaining in a copper electrolyte used in the method, comprising;

electrolyzing in an electrodeposition cell a composition-adjusted, thiourea-added copper sulfate solution, to thereby produce electrodeposited copper foil;

feeding a low copper-concentration copper sulfate spent solution, discharged from the electrodeposition cell to a circulation filtration apparatus for circulation-filtration in contact with granular activated carbon, to thereby remove substantially all the thiourea-decomposed products;

preparing a high-copper-concentration copper sulfate solution in a copper dissolution vessel by feeding the spent solution substantially free of thiourea-decomposition products from the filtration step to a copper dissolution vessel, whereby said spent solution serves as a sulfuric acid solution for dissolving copper and;

adding thiourea into the high-copper-concentration copper sulfate solution to produce a composition-adjusted, thiourea-added, copper sulfate solution;

and feeding the composition-adjusted, thiourea-added, copper sulfate solution to the electrodeposition cell, to thereby again serve as an electrolyte.

2. A method for continuous production of electrodeposited copper foil according to claim 1, wherein the granular activated carbon has a particle size of 8 mesh to 50 mesh.

3. An electrodeposited copper foil obtained through electrolysis of a thiourea-added copper sulfate solution by use of a method according to claim 1, characterized by exhibiting a high resistivity, as measured in the foil with surface treatment, of 0.190–0.210 $\Omega$-g/m$^2$ for a nominal thickness of 3 $\mu$;

0.180–0.195 $\Omega$-g/m$^2$ for a nominal thickness of 9 $\mu$;

0.170–0.185 $\Omega$-g/m$^2$ for a nominal thickness of 18 $\mu$; and 0.170–0.180 $\Omega$-g/m$^2$ for a nominal thickness of 35 $\mu$; or more, and by assuming a low-profile surface having an average surface roughness (Ra) of 0.1–0.3 $\mu$m.

4. A method for continuous production of electrodeposited copper foil according to claim 1, wherein the circulation-filtration apparatus enables the spent solution to undergo circulation-filtration treatment at 200–500 liters/minute for 30 minutes or longer by use of granular activated carbon in an amount of 400–500 kg.

5. A method for the continuous production of electrodeposited copper foil while removing thiourea-decomposed products remaining in a copper electrolyte used in the method, comprising;

electrolyzing in an electrodeposition cell a composition-adjusted, thiourea-added copper sulfate solution, to thereby produce electrodeposited copper foil;

filtering a low copper-concentration copper sulfate spent solution, discharged from the electrodeposition cell through an ultrafiltration apparatus strainer on which is formed a filtration layer comprising a filtration aid and powdery activated carbon, to thereby remove substantially all the thiourea-decomposed products;

preparing a high-copper-concentration copper sulfate solution in a copper dissolution vessel by feeding the spent solution substantially free of thiourea-decomposition products from the filtration step to a copper dissolution vessel, whereby said spent solution serves as a sulfuric acid solution for dissolving copper;

adding thiourea into the high-copper-concentration copper sulfate solution to produce a composition-adjusted, thiourea-added, copper sulfate solution;

and feeding the composition-adjusted, thiourea-added, copper sulfate solution to the electrodeposition cell, to thereby serve as an electrolyte again.

6. A method for continuous production of electrodeposited copper foil according to claim 5, wherein the filtration layer formed on the strainer is produced by forming in advance a pre-coat layer comprising a filtration aid in the strainer;

placing the strainer in the ultrafiltration apparatus;

introducing into the ultrafiltration apparatus a pre-treatment solution containing powdery activated carbon and circulating the solution in the apparatus, to thereby trap powdery activated carbon in a surface layer of the pre-coat layer and fixed the powdery activated carbon in the pre-coat layer.

7. A method for continuous production of electrodeposited copper foil according to claim 6, wherein the powdery activated carbon has a particle size of 50 mesh to 250 mesh.

8. A method for continuous production of electrodeposited copper foil according to claim 6, wherein the powdery activated carbon is formed on the pre-coat layer in a coating thickness of 5–20 mm.

9. A method for continuous production of electrodeposited copper foil according to claim 6, wherein the filtration aid comprises diatomaceous earth having a particle size of 3–40 $\mu$m and is formed by mixing diatomaceous earth having a particle size of 3–15 $\mu$m and diatomaceous earth having a particle size of 16–40 $\mu$m at a proportion of 7:3.

10. An electrodeposited copper foil obtained through electrolysis of a thiourea-added copper sulfate solution by use of a method according to claim 6, characterized by exhibiting a high resistivity, as measured in the foil with surface treatment, of 0.190–0.210 $\Omega$-g/m$^2$ for a nominal thickness of 3 $\mu$;

0.180–0.195 $\Omega$-g/m$^2$ for a nominal thickness of 9 $\mu$;

0.170–0.185 $\Omega$-g/m$^2$ for a nominal thickness of 18 $\mu$; and 0.170–0.180 $\Omega$-g/m$^2$ for a nominal thickness of 35 $\mu$; or more, and by assuming a low-profile surface having an average surface roughness (Ra) of 0.1–0.3 $\mu$m.

11. A method for continuous production of electrodeposited copper foil according to claim 5, wherein the powdery activated carbon has a particle size of 50 mesh to 250 mesh.

12. A method for continuous production of electrodeposited copper foil according to claim 5, wherein the powdery activated carbon is formed on the pre-coat layer in a coating thickness of 5–20 mm.

13. A method for continuous production of electrodeposited copper foil according to claim 5, wherein the filtration aid comprises diatomaceous earth having a particle size of 3–40 $\mu$m and is formed by mixing diatomaceous earth having a particle size of 3–15 $\mu$m and diatomaceous earth having a particle size of 16–40 $\mu$m at a proportion of 7:3.

14. An electrodeposited copper foil obtained through electrolysis of a thiourea-added copper sulfate solution by use of a method according to claim 5, characterized by exhibiting a high resistivity, as measured in the foil with surface treatment, of 0.190–0.210 $\Omega$-g/m$^2$ for a nominal thickness of 3 $\mu$;

0.180–0.195 $\Omega$-g/m$^2$ for a nominal thickness of 9 $\mu$;

0.170–0.185 $\Omega$-g/m$^2$ for a nominal thickness of 18 $\mu$; and 0.170–0.180 $\Omega$-g/m$^2$ for a nominal thickness of 35 $\mu$; or more, and by assuming a low-profile surface having an average surface roughness (Ra) of 0.1–0.3 $\mu$m.

15. An electrodeposition apparatus comprising a path for circulating a copper sulfate solution, comprising an electrodeposition cell for electrolyzing a composition-adjusted, thiourea-added copper sulfate solution, to thereby produce electrodeposited copper foil;

a circulation-filtration apparatus, in fluid connection with the electrodeposition cell, for circulation-filtration treatment of a low copper-concentration copper sulfate solution, discharged from the electrodeposition cell, to remove thiourea-decomposed products by use of activated granular carbon;

a copper dissolution vessel, in fluid connection with the circulation-filtration apparatus, for dissolving copper using the filtered low copper-concentration copper sulfate solution as a sulfuric acid solution and prepare a high-copper-concentration copper sulfate solution;

a thiourea addition vessel, in fluid connection with the copper dissolution vessel, for incorporating a thiourea additive into the high-copper-concentration copper sulfate solution, to produce a composition-adjusted, thiourea-added, copper sulfate solution;

and an electrodeposition cell conduit, in fluid connection with the thiourea addition vessel, for feeding the composition-adjusted, thiourea-added, copper sulfate solution to the electrodeposition cell, to thereby serve as an electrolyte again.

16. An electrodeposition apparatus according to claim 15, wherein the granular activated carbon has a particle size of 8 mesh to 50 mesh.

17. An electrodeposition apparatus according to claim 15, wherein the circulation-filtration apparatus enables the spent solution to undergo circulation-filtration treatment at 200–500 liters/minute for 30 minutes or longer by use of granular activated carbon in an amount of 400–500 kg.

18. An electrodeposition apparatus comprising a path for circulating a copper sulfate solution, comprising an electrodeposition cell for electrolyzing a composition-adjusted, thiourea-added copper sulfate solution, to thereby produce electrodeposited copper foil;

an ultrafiltration strainer, in fluid connection with the electrodeposition cell, on which is formed a filtration layer comprising a filtration aid and powdery activated carbon for ultrafiltration treatment of a low copper-concentration copper sulfate solution, discharged from the electrodeposition cell, to remove thiourea-decomposed products;

a copper dissolution vessel, in fluid connection with the ultrafiltration strainer, for dissolving copper using the filtered low copper-concentration copper sulfate solution as a sulfuric acid solution and prepare a high-copper-concentration copper sulfate solution;

a thiourea addition vessel, in fluid connection with the copper dissolution vessel, for incorporating a thiourea additive into the high-copper-concentration copper sulfate solution, to produce a composition-adjusted, thiourea-added, copper sulfate solution;

and an electrodeposition cell conduit, in fluid connection with the vessel, for feeding the composition-adjusted, thiourea-added, copper sulfate solution to the electrodeposition cell, to thereby serve as an electrolyte again.

19. An electrodeposition apparatus for use in continuous production of electrodeposited copper foil according to claim 18, wherein the filtration layer formed on the strainer is produced by forming in advance a pre-coat layer comprising a filtration aid in the strainer;

placing the strainer in the ultrafiltration apparatus;

introducing into the ultrafiltration apparatus a pre-treatment solution containing powdery activated carbon and circulating the solution in the apparatus, to thereby trap powdery activated carbon in a surface layer of the pre-coat layer and fix the powdery activated carbon in the pre-coat layer.

20. An electrodeposition apparatus for use in continuous production of electrodeposited copper foil according to claim 19, wherein the powdery activated carbon has a particle size of 50 mesh to 250 mesh.

21. An electrodeposition apparatus for use in continuous production of electrodeposited copper foil according to claim 19, wherein the powdery activated carbon is formed on the pre-coat layer in a coating thickness of 5–20 mm.

22. An electrodeposition apparatus for use in continuous production of electrodeposited copper foil according to claim 19, wherein the filtration aid comprises diatomaceous earth having a particle size of 3–40 $\mu$m and is formed by mixing diatomaceous earth having a particle size of 3–15 $\mu$m and diatomaceous earth having a particle size of 16–40 $\mu$m at a proportion of 7:3.

23. An electrodeposition apparatus for use in continuous production of electrodeposited copper foil according to claim 18, wherein the powdery activated carbon has a particle size of 50 mesh to 250 mesh.

24. An electrodeposition apparatus for use in continuous production of electrodeposited copper foil according to claim 18, wherein the powdery activated carbon is formed on the pre-coat layer in a coating thickness of 5–20 mm.

25. An electrodeposition apparatus of use in continuous production of electrodeposited copper foil according to claim 18, wherein the filtration aid comprises diatomaceous earth having a particle size of 3–40 $\mu$m and is formed by mixing diatomaceous earth having a particle size of 3–15 $\mu$m and diatomaceous earth having a particle size of 16–40 $\mu$m at a proportion of 7:3.

26. An electrodeposition apparatus comprising a path for circulating a copper sulfate solution, comprising an electrodeposition cell means for electrolyzing a composition-adjusted, thiourea-added copper sulfate solution, to thereby produce electrodeposited copper foil;

a circulation-filtration means, in fluid connection with the electrodeposition cell, for the circulation-filtration treatment of a low copper-concentration copper sulfate solution, discharged from the electrodeposition cell, to remove thiourea-decomposed products by use of activated granular carbon;

a copper dissolution means, in fluid connection with the circulation-filtration means, for dissolving copper using the filtered low copper-concentration copper sulfate solution as a sulfuric acid solution to prepare a high-copper-concentration copper sulfate solution;

a thiourea addition means, in fluid connection with the copper dissolution means, for incorporating a thiourea additive into the high-copper-concentration copper sulfate solution, to produce a composition-adjusted, thiourea-added, copper sulfate solution;

and an electrodeposition cell feed means, in fluid connection with the thiourea addition means, for feeding the composition-adjusted, thiourea-added, copper sulfate solution to the electrodeposition cell, to thereby serve as an electrolyte again.

27. An electrodeposition apparatus comprising a path for circulating a copper sulfate solution, comprising an electrodeposition cell means for electrolyzing a composition-adjusted, thiourea-added copper sulfate solution, to thereby produce electrodeposited copper foil;

an ultrafiltration means, in fluid connection with the electrodeposition cell, for the ultrafiltration treatment of a low copper-concentration copper sulfate solution, discharged from the electrodeposition cell, to remove thiourea-decomposed products by use of powdery activated carbon;

a copper dissolution means, in fluid connection with the ultrafiltration means, for dissolving copper using the filtered low copper-concentration copper sulfate solution as a sulfuric acid solution to prepare a high-copper-concentration copper sulfate solution;

a thiourea addition means, in fluid connection with the copper dissolution means, for incorporating a thiourea additive into the high-copper-concentration copper sulfate solution, to produce a composition-adjusted, thiourea-added, copper sulfate solution;

and an electrodeposition cell feed means, in fluid connection with the thiourea addition means, for feeding the composition-adjusted, thiourea-added, copper sulfate solution to the electrodeposition cell, to thereby serve as an electrolyte again.

* * * * *

UNITED STATES PATENT AND TRADEMARK OFFICE

CERTIFICATE OF CORRECTION

PATENT NO. : 6,652,725 B2 
DATED : November 25, 2003
INVENTOR(S) : Kazuko Taniguchi et al.

It is certified that error appears in the above-identified patent and that said Letters Patent is hereby corrected as shown below:

Title page,
Item [73], Assignee, should read
-- Mitsui Mining & Smelting Co., Ltd., Tokyo, Japan --.

Signed and Sealed this

Tenth Day of January, 2006

JON W. DUDAS
*Director of the United States Patent and Trademark Office*